US008499710B2

(12) United States Patent
Marshall

(10) Patent No.: US 8,499,710 B2
(45) Date of Patent: Aug. 6, 2013

(54) BREAST POINT DOCKING SYSTEM

(75) Inventor: George Frederick Marshall, Fort Lauderdale, FL (US)

(73) Assignee: Sunbelt Leasing Ltd., Raleigh, NC (US)

( * ) Notice: Subject to any disclaimer, the term of this patent is extended or adjusted under 35 U.S.C. 154(b) by 93 days.

(21) Appl. No.: 12/805,125

(22) Filed: Jul. 14, 2010

(65) Prior Publication Data

US 2011/0011321 A1 Jan. 20, 2011

Related U.S. Application Data

(60) Provisional application No. 61/225,577, filed on Jul. 15, 2009.

(51) Int. Cl.
*B63B 21/04* (2006.01)

(52) U.S. Cl.
USPC ..... 114/230.22; 114/230.27; 405/215

(58) Field of Classification Search
USPC ..... 114/230.16, 230.2, 230.22, 230.24, 114/230.27, 293, 219, 220; 405/213, 215
See application file for complete search history.

(56) References Cited

U.S. PATENT DOCUMENTS

| | | | | |
|---|---|---|---|---|
| 3,462,960 | A * | 8/1969 | Bruehl | 405/214 |
| 4,309,954 | A * | 1/1982 | Szuch | 114/230.24 |
| 4,480,576 | A * | 11/1984 | Mills | 114/230.27 |
| 5,265,553 | A * | 11/1993 | Brydges | 114/230.22 |
| 5,282,434 | A * | 2/1994 | Hart et al. | 114/230.16 |
| 5,603,280 | A * | 2/1997 | Shackelford, Jr. | 114/230.27 |
| 5,762,016 | A * | 6/1998 | Parsons | 114/219 |
| 6,216,625 | B1 * | 4/2001 | Baluha | 114/230.27 |
| 6,443,086 | B1 * | 9/2002 | Actis-Grande et al. | 114/230.24 |
| 7,322,307 | B1 * | 1/2008 | Perry | 114/230.2 |

* cited by examiner

*Primary Examiner* — Lars A Olson
(74) *Attorney, Agent, or Firm* — Nixon & Vanderhye

(57) ABSTRACT

Docking system for securing a craft to a dock or slip using a single line secured to the middle cleat of the boat. The system includes a mounting system, a docking car assembly slideably mounted on the mounting system; at least one bumper mounted on the docking car assembly; a biasing system which urges the docking car assembly is a first direction on the mounting system; and a docking line connected to the docking car assembly, a docking line connected to said docking car assembly, wherein when a force is placed on the docking line, the docking car is urged in a direction opposite to the first direction. Adjustable bumpers are provided which prevent the craft from rotating about the point of attachment.

22 Claims, 8 Drawing Sheets

BREAST POINT DOCKING SYSTEM

This is a new utility application which claims benefit of Provisional Application No. 61/225,577, filed Jul. 15, 2009, the entire content of which is hereby incorporated by reference in this application.

The present invention relates to a boat docking system. More specifically, the invention relates to a breast point docking system designed primarily for securing 30 to 90 foot pleasure boats to a dock or slip, using a single line secured to the middle cleat present on almost all powerboats and many sailboats. The single line is secured to a bumper system that can rise and fall with the tides, and adjustable bumpers prevent the craft from rotating about the point of attachment.

BACKGROUND OF THE INVENTION

Most pleasure craft in the size range of 30-90 feet are docked alongside a quay, or are secured in a slip. For securing a boat to a quay, four lines are typically required—a bowline, a stern line, and two spring lines, fore and aft. The bow and stern lines hold the craft to the dock, and the spring lines prevent it from moving fore and aft. One or more bumpers are usually needed to prevent chafing against the dock, and each bumper is held in place by one or two lines. A disadvantage with bumpers is that they are bulky and require extra storage space on the craft to avoid them moving around while underway.

Securing a boat in a standard slip typically requires five lines—two bowlines, two stern lines, and one spring line. Bumpers are not normally required, although they may be employed depending on the size and layout of the slip.

If the craft has a crew, which is normally the case for significantly larger boats, docking is ordinarily not a problem for the owners of the boat. The crew takes care of it, and the owners are not concerned about maneuvering the boat or how much time it takes to secure the boat.

For yachts in the 30 to 65-90 foot range, many owners wish to operate the craft by themselves. They may employ a captain in certain circumstances, but they usually enjoy the actual boat operation themselves. They may take pleasure from the navigation and steering; they may wish the privacy that comes from not having a crew; they may regard the expense and management of a crew as burdensome; or some part or all of the above. In many instances, the owners of such yachts are couples, typically husband and wife, and it is not unusual of the husband to assume the role of captain and the wife first mate. When the yacht is underway, typically no major issues arise, as the captain usually assumes responsibility for the navigation and operation of the boat and, if the boat is equipped with an autopilot, most of the steering is accomplished automatically. However, docking the boat can be challenging, where the captain is fully occupied positioning the vessel, and the mate assumes responsibility for setting the lines and securing the vessel. Tension between the captain and his mate is not uncommon during these procedures, and can spoil what has otherwise been a pleasant voyage.

A need exists for a docking system which eliminates or reduces the time and skill required for crew members to position a vessel on docking. The present invention seeks to satisfy that need.

BRIEF DESCRIPTION OF THE INVENTION

The present invention provides a docking system which makes it possible to secure a craft typically in the 30 to 90 foot range to a dock or slip using a single line secured to the middle cleat present on almost all powerboats and many sailboats. The single line is secured to a bumper arrangement that can rise and fall with the tides. Adjustable bumpers are provided which prevent the craft from rotating about the point of attachment.

In one embodiment, there is provided a docking system comprising a mounting system; a docking car assembly slideably mounted on said mounting system; at least one bumper mounted on said docking car assembly; a biasing system which urges the docking car assembly in a first direction on the mounting system; and a docking line connected to the docking car assembly, wherein when a force is placed on the docking line, the docking car is urged in a direction opposite to the first direction.

In another embodiment, there is provided a docking assembly suitable for mounting on a dock or quay, comprising a docking system as defined above, and first and second bumper carrying devices positionable on a dock or quay on either side of the docking system and spaced from the docking system by a distance such that when a craft is secured to the docking system and bumpers on the bumper carrying devices are in contact with the craft, rotation of the craft about the docking system is prevented.

In a further embodiment, there is provided a method for docking a craft at a dock or quay, comprising bringing a craft alongside a docking assembly which includes a docking system as defined above and first and second bumper carrying devices positioned on the dock or quay on either side of the docking system, hitching the docking line to a center cleat of the craft, pulling on the docking line to draw the craft into contact with bumpers on the docking system, cleating the docking line, and moving the bumper carrying devices to bring the bumpers carried by the bumper carrying devices into contact with the craft on either side of the docking system.

The system of the present invention is known as a breast point system. This arises from the expression "breast line" which a nautical term for a dock line that is perpendicular to the side of a boat, or that secures a boat to a piling by the center cleat.

BRIEF DESCRIPTION OF THE DRAWINGS

The invention will be described in more detail with reference to the accompanying drawings, in which.

DETAILED DESCRIPTION OF THE INVENTION

Figure 2:
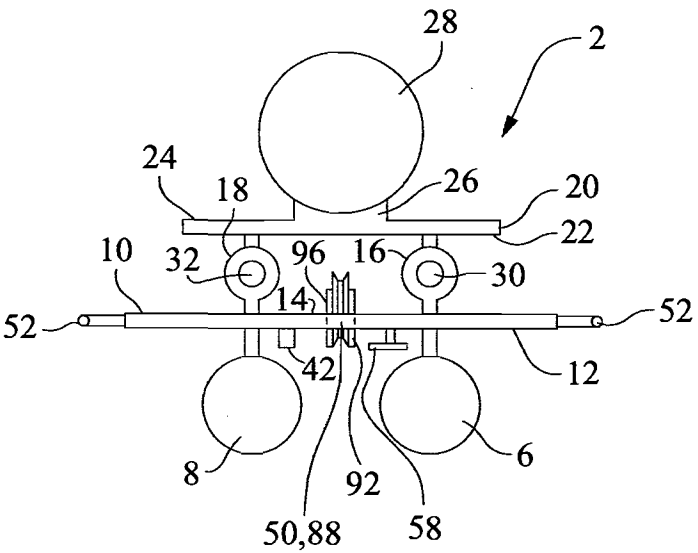
FIG. 2 is a plan view of the docking system of FIG. 1 with the docking line omitted.
Figure 1:
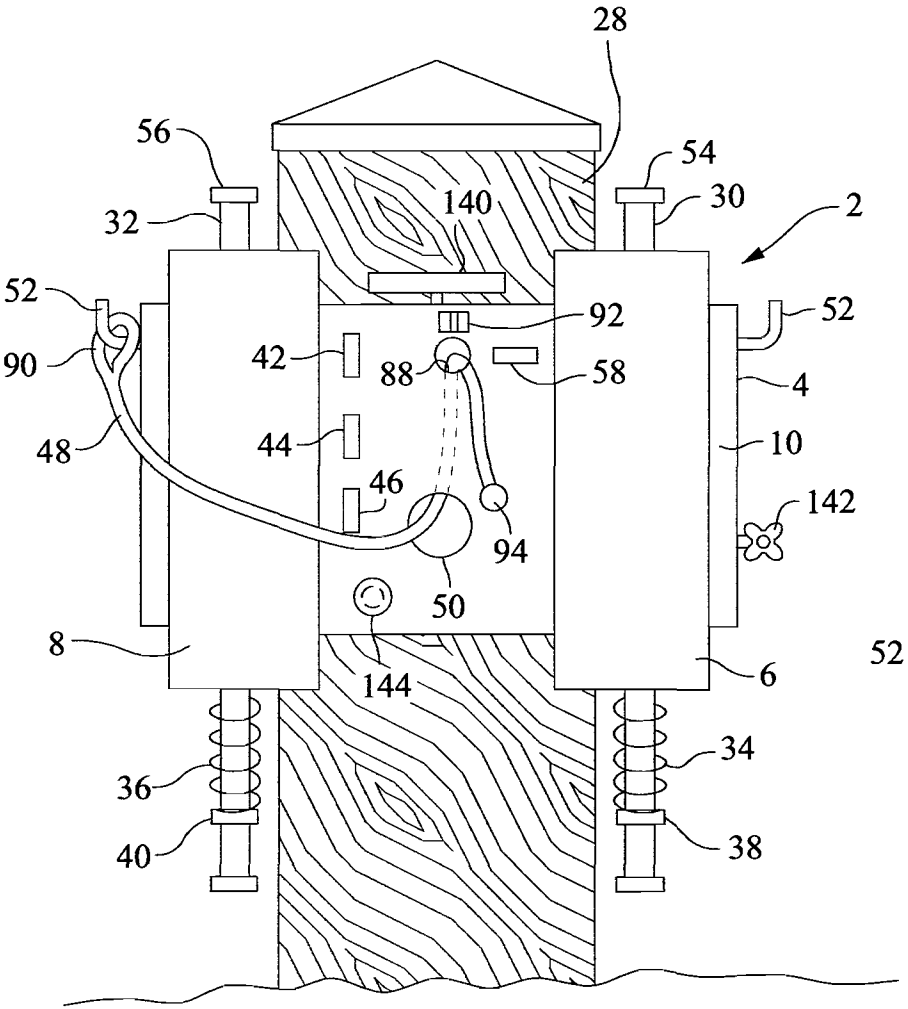
FIG. 1 is a front view of one embodiment of the docking system of the invention, as viewed from the water, mounted to a pylon.
Figure 3B:
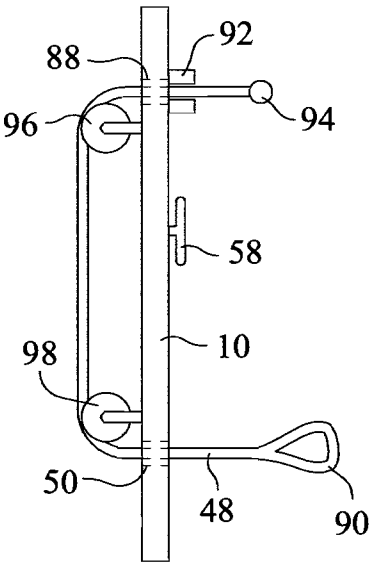
FIGS. 3*a* and 3*b* are side views of the docking system of FIG. 1.
Figure 3C:
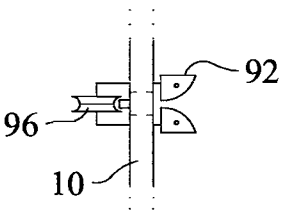
FIG. 3*c* is a partial plan view of the docking system of FIG. 1.
Figure 3A:
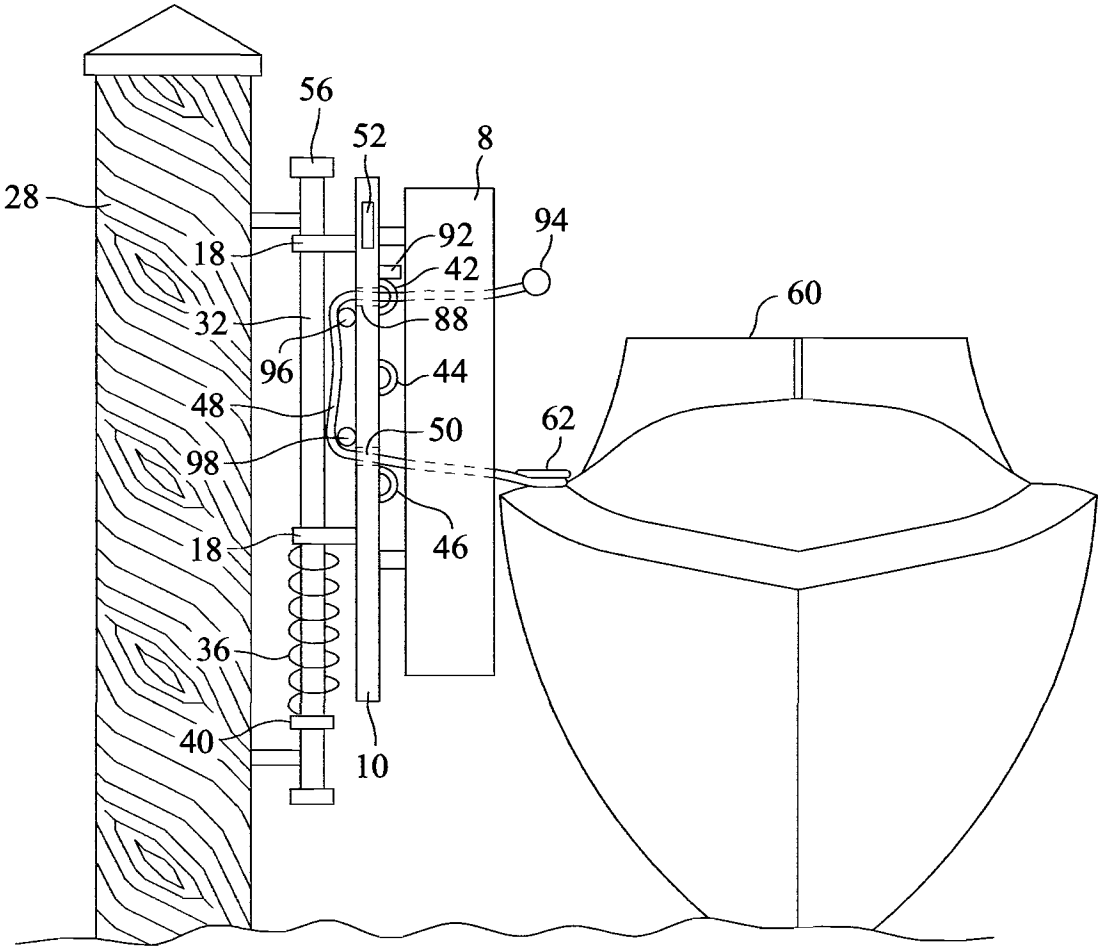

Referring to FIGS. 1 and 2, there is shown a first embodiment of a docking system which includes a docking car assembly 2 having a docking car 4 provided with two bumpers 6,8 mounted to a support member 10. The support member has a front face 12 and a rear face 14. Mounting rings 16 and 18 are provided on the rear face 14 of the support member 10, and are generally positioned so as to be in alignment with the bumpers 6,8, as shown in FIG. 2. Typically four mounting rings are provided, two vertically one above the other behind bumper 6 and two vertically one above the other behind bumper 8 (FIG. 3*a*).

The docking system 2 further comprises a mounting system including a mounting plate 20 having a front face 22 and a rear face 24. The rear face 24 is provided with an attachment bracket 26 for mounting the mounting plate 20 to a support, such as a pylon 28. The front face 22 of the mounting plate 20 is provided with longitudinally extending rod members 30,32 which are spaced apart from each other by the same distance as the mounting rings 16,18 so as to permit the mounting rings of the docking car assembly to be slidably mounted on the rods 30,32 of the mounting system.

Each mounting rod member is provided with a biasing system for urging the rings 16,18 upwardly on the rods 30, 32. This biasing system may be in the form of springs 34,36, each of which is retained on the respective rod member by stop members 38,40. The internal diameter of the mounting rings 16 and 18 and the external diameter of the rod members 30,32 are such that the rings may be slideably engaged on the rod members but with a small amount of play to reduce rattle. The springs 34,36 serve to urge the docking car 4 upwardly for ease of access when docking and to reduce downward looping of dock line 48.

The support member 10 is further provided on the front face 12 with gripping means such as handles 42,44, 46 to allow a crew member on a boat to take hold of the docking car 4, irrespective of the tide level. This permits the crew member to pull the docking car 4 downwards against the biasing effect of the springs to allow the person to grab the dock line 48 mounted on hook 52.

The support member 10 is provided with two apertures 50,88 through which the line 48 extends, as shown in FIGS. 1 and 2. A guide member such as, for example, pulleys 96,98 are mounted on the rear face 14 of the support member 10 and behind each aperture 50,88, over which the line 48 passes, as shown in FIG. 3*b*.

The line 48 may be provided at one end with a loop 90 to allow the line to be easily attached to and removed from hook 52. The other end of the line 48 may be provided with a ball 94 or other enlarged region to allow the line to be grabbed, and also to prevent the line 48 from disappearing back though the aperture 88.

A jam cleat 92 is provided on the front face 12 of the support member 10 to secure the line 48 as it is pulled though the aperture 88, and to prevent it from going back through the aperture 88. A permanent cleat 58 may also be provided on the front face 12 as a further point of securing the line 48.

The rods 30,32 are provided at their upper ends with stop members 54,56. These stop members prevent disengagement of the docking car 4 from the rods 30,32.

FIG. 3*a* illustrates the system of FIG. 1 from the side. A boat 60 is shown secured to the docking system by line 48 tied to the middle cleat 62 of the boat. FIG. 3*b* is a partial side view showing the pulleys 96,98 mounted to the rear face 14 of the support member 10. FIG. 3*c* is a partial plan view showing the jam cleat 92 mounted on the front face 12 of the support member 10 and generally opposite the pulley 96.

Vertical movement of the docking car 4 on the rods 30,32 is permitted as the tide rises and falls. The docking system is designed such that the distance between the stop members 54,56 at the top of the rods and the bottom of the rods is greater than the difference between low and high tide to allow for maximum vertical movement of the docking car 4 between low and high tide.

Figure 5:
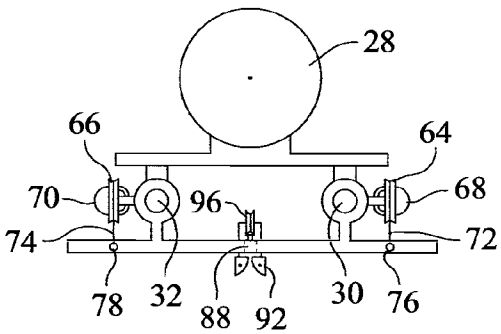
FIG. 5 is a plan view of the embodiment of FIG. 4 with the bumpers removed.
Figure 4:
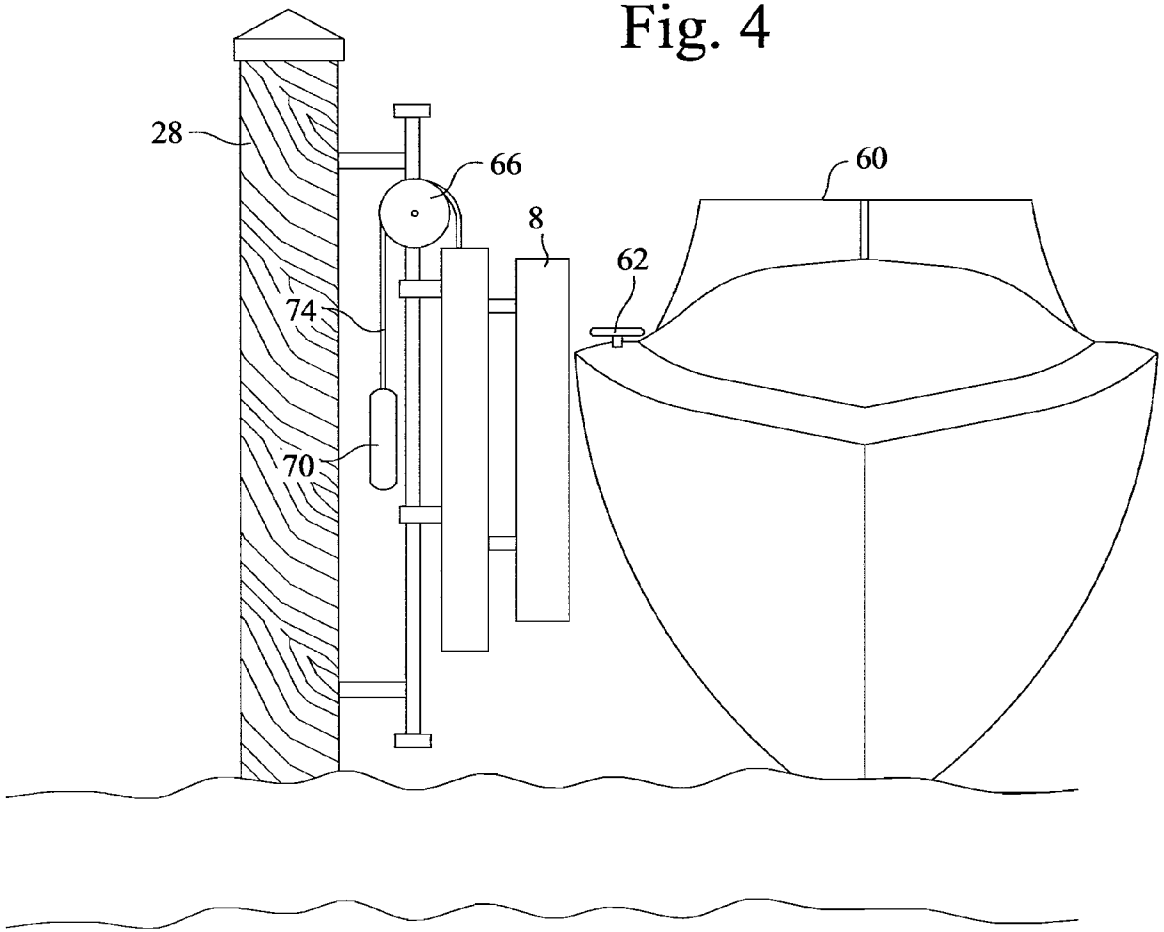
FIG. 4 is a side view of a second embodiment of the docking system of the invention.

FIGS. 4 and 5 illustrate an alternative embodiment of the docking system of the invention in which the biasing means for urging the docking car 4 in an upward direction comprises a weighted pulley system. This biasing system includes pulleys 64,66 rotatably mounted on each rod 30,32, and a counter-weight 68,70 connected to the support member 10 via a connecting line 72,74 which extends from the counter-weight around a groove provided in the pulley circumference to attachment points 76,78 on the support member 10.

Figure 6:
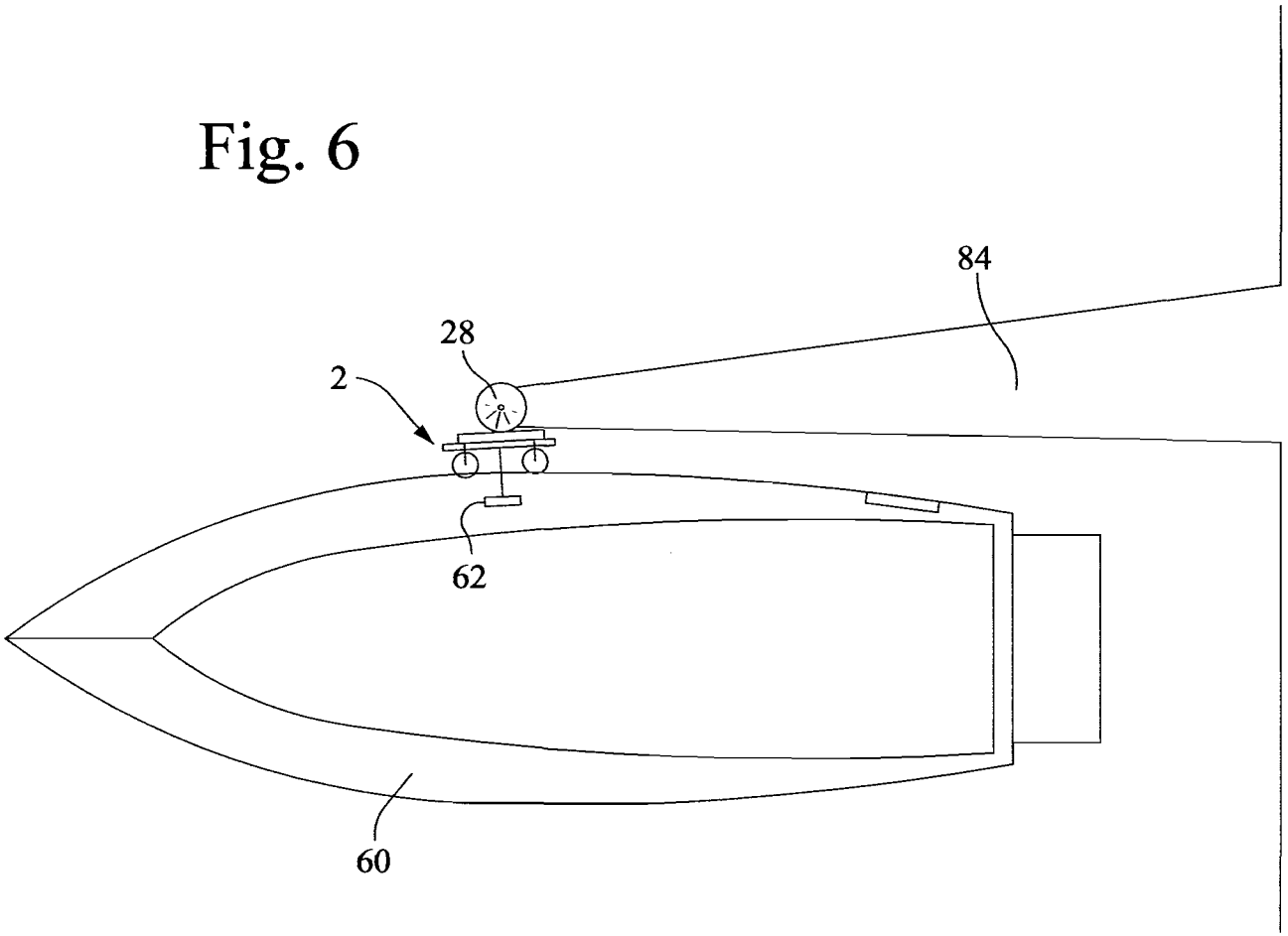
FIG. 6 is a plan view of the docking system of the invention when employed in a boat slip.

FIG. 6 illustrates the use of the docking system of the invention in a boat slip. In this arrangement, finger 84 of the slip extends to a pylon 28 where the docking system 2 of the invention is mounted, and to which the center cleat 62 of the boat 60 can be hitched.

Figure 7:
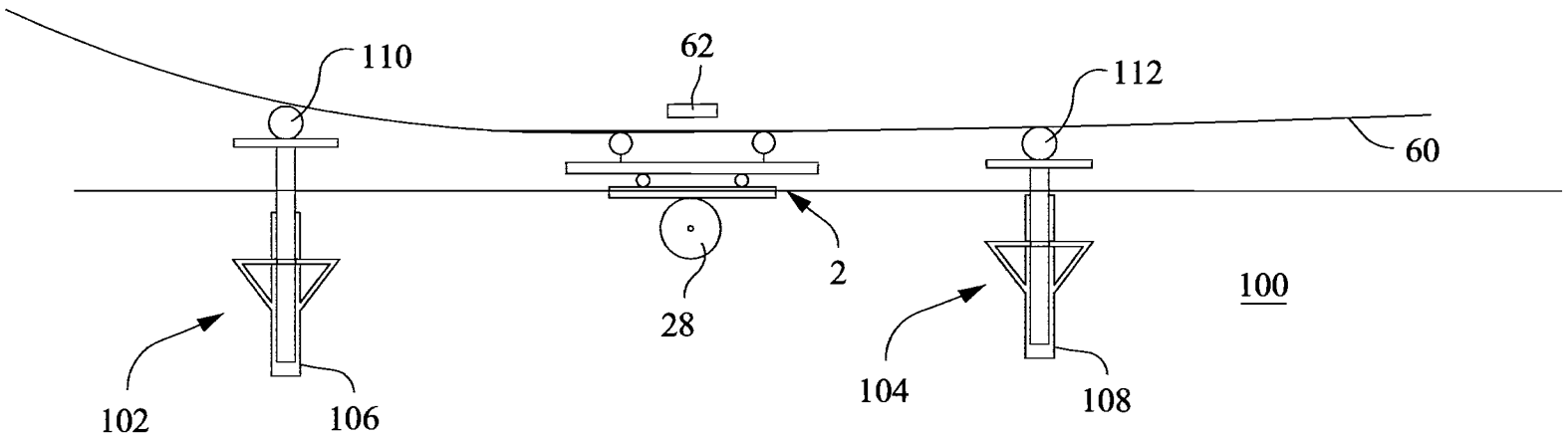
FIG. 7 is a plan view of the docking system of the invention as used on a quay.

FIG. 7 illustrates in plan view a system of FIG. 1 as employed on a dock 100. Once the boat 60 is secured to the docking system 2, rotational movement of the boat about the docking system is prevented by a moveable bumper system which permits bumpers disposed on either side of the docking system 2 to be moved towards and away from the boat. An embodiment of such a moveable bumper system is illustrated in FIG. 7, which shows first and second bumper carrying devices 102,104 disposed on either side of the docking car 4 and each mounted on an in-dock track 106,108 recessed into the dock 100. Bumpers 110,112 are provided on the bumper carrying devices 102,104. Typically, the bumpers 110,112 are spaced about 10 feet on either side of the docking car 4.

Movement of the bumper carrying devices 102,104 towards the boat brings bumpers 110,112 into contact with the boat 60 to prevent rotation of the boat about the docking system 2. Typically, one bumper is present on each bumper carrying device, but more than one bumper may be used, if desired.

Figure 8:
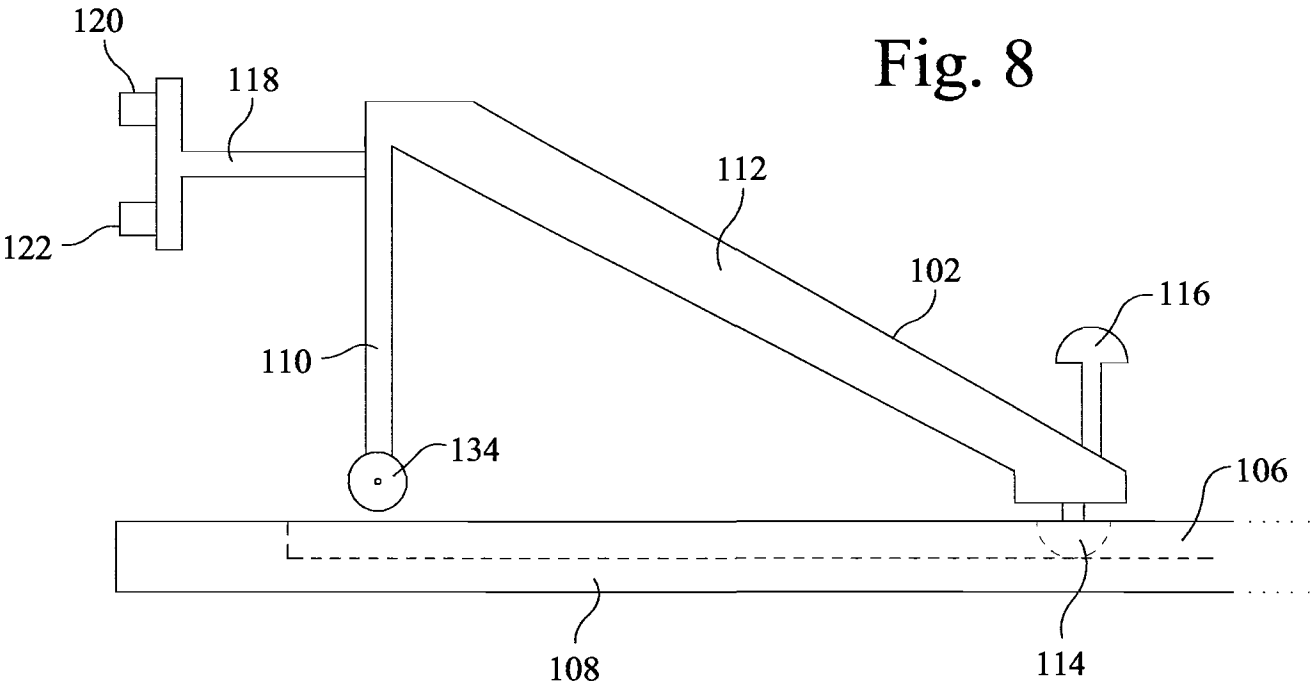
FIG. 8 is a side view of a tripod bumper carrying device the of the invention.

FIG. 8 is side view of a tripod bumper carrying device of the invention, comprising a frame including outrigger members 110 having a wheel 134 connected to a lower end of each outrigger member. The upper end of each outrigger member is connected to a sloping central member 112. The lower end of the sloping member 112 is connected to a foot 114 which is configured to slideably engage with the in-dock track 106. Movement along the in-dock track 106 is facilitated by lifting and then pulling or pushing the device using the handle 116.

A carrying unit 118 is mounted on the frame at the opposite end to the foot 114. The carrying unit 118 is provided with upper and lower tracks 120,122 on which the moveable bumpers 110,112 are mounted. The tracks 120,122 also permit lateral sideways adjustment of the bumper(s).

As an alternative (not shown), in the situation where there is no pylon situated close to the dock, the docking car 4 may be mounted on its own tripod bumper carrying device, and will be moveable towards and away from the boat in the same way as are the outer tripod bumper carrying devices with the bumpers 110,112. In this instance, three in-dock tracks will be present, with the docking car 2 mounted to the horizontal tracks 120,122 of center tripod bumper carrying device. As with the bumpers mounted on the tracks 120,122, sideways lateral adjustment of the docking car 4 on the tracks 120,122 can be effected, if desired.

Figure 9A:
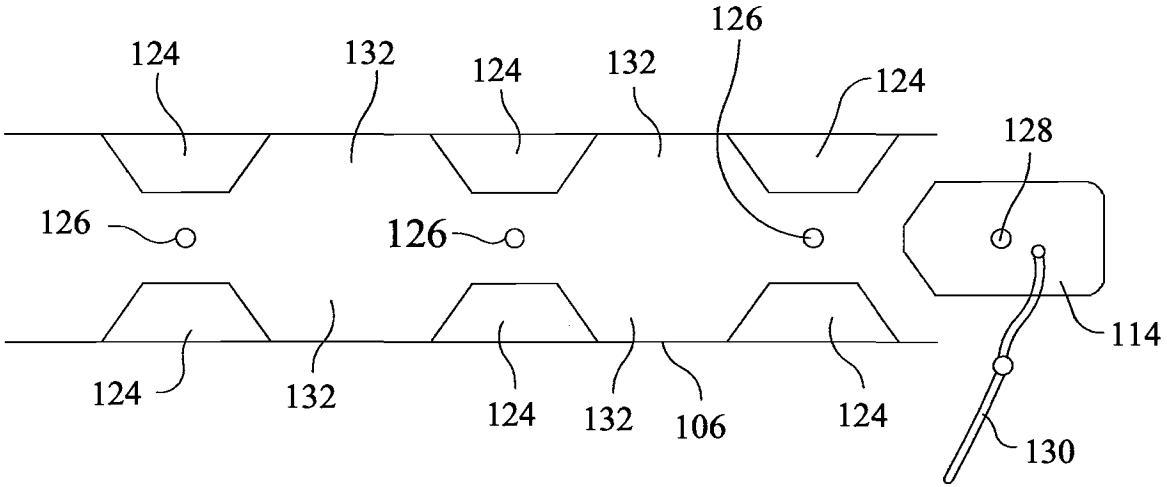
FIG. 9*a* is a plan view of the in-dock track employed in the invention.
Figure 9B:
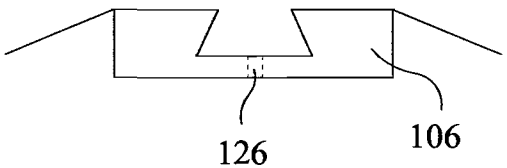
FIG. 9*b* is a view from the end of the track.

FIG. 9*a* is a plan view of an in-dock track 106 employed in the invention. FIG. 9*b* is a view of the track from the end. The track 106 includes keeper members 124 positioned longitudinally along the length of the track and defining spaces 132 which extend a distance longitudinally which is slightly longer than the length of the foot 114. A hole 126 is located in the base of the track between each of the keeper members 124. The hole 126 is for receiving a fastening pin 130 mounted to the foot 114, by passing the pin through the hole 128 in the foot and into a respective hole 126 in the base of the track, to thereby fix the foot in a desired position once the bumpers are in position either against the side of the boat or back on the dock when not in use.

A bumper carrying device 102 may be removed from the track 106 by pulling the pin 130 out of the holes 126 and 128, sliding the bumper carrying device along the track 106 to align the foot 114 with a space 132 between the keepers, and lifting the foot out of the track using the handle 116. The bumper carrying device can then be removed from the dock area or relocated on a different track by lifting the foot 114 clear of the ground using handle 116 and rolling the device on the wheels 134.

Figure 10:
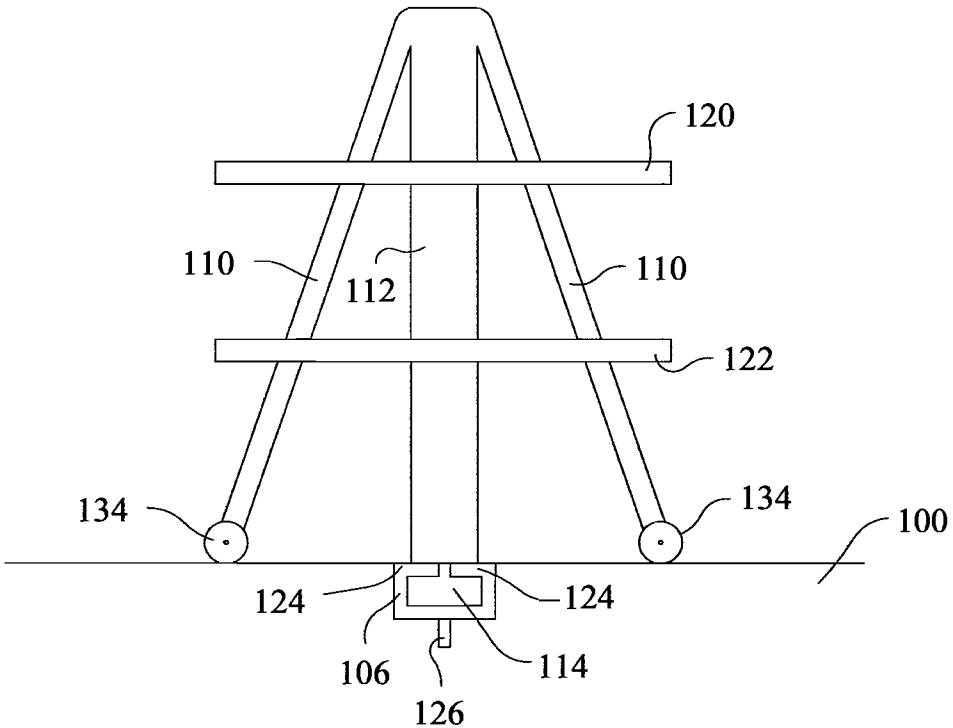
FIG. 10 is a view of the tripod bumper carrying device as viewed from the water.

FIG. 10 is an end view of the tripod bumper carrying device of the invention as viewed from the water. The outrigger members 110 extend outwardly at an angle of about 60-70 degrees to stabilize the tripod against tipping.

The docking system of the invention may be provided with a shore-power outlet 144 and water hose connection 142, as are typically found in boat slips and docks. A light 140 may also be provided to illuminate the docking system at night.

In use when docking, as the boat 60 comes alongside the docking system 2, the mate grabs one of the handles 42-46, removes the line 48 from the hook 52 and ties the line to the center cleat 62 of the boat. This secures the boat to the docking system. The mate then grabs the ball 94 at the other end of the line 48 and pulls on the line 48. This causes the line 48 to move around the pulleys 96,98 and out of the aperture 88, and urges the docking car 4 to move downwards on the rods 16,18 against the effect of biasing system 34,36. As the boat 60 is drawn into contact with the bumpers 6,8, the line 48 may be temporarily cleated in the jam cleat 92 until the tripod bumper carrying devices 102,104 are located in position. This is achieved by lifting the tripod bumper carrying devices by the handles 116 and moving them towards the boat with the foot sliding in the track. When the bumpers come into contact with the boat, the foot 114 is adjusted to a position where the pin 130 can be inserted though hole 128 in the foot into a respective hole 126 to prevent further movement in the track. Both the moveable bumpers and the docking car can be moved a few feet towards or away from the boat along the respective in-dock tracks for fine tuning adjustments. Once all bumpers are finally positioned against the boat, the line 46 may be hitched to the permanent cleat 58 to fully secure the boat to the docking system.

The system described above is designed for concrete or wooden docks with the boat tied alongside. The system may also be employed in slips, or for fastening the car to wood or concrete pilings instead of horizontal docks.

Piling mounts may place docking car and/or the bumpers in fixed position, either directly in front of piling or offset to one side or the other. Piling mounting may also contain horizontal tracks, so the docking car and/or the bumpers may be adjusted from side to side.

It will not be necessary in most cases, but a version of the piling mount could have tracks similar to in-dock tracks, so that the docking car could be adjusted outward from the piling. This would require two tracks, one on each side of the piling. Different versions could be adjustable both from side to side and closer or further from the piling, or either or neither.

A less expensive version will be available for slip owners that know exactly where the docking car needs to be, as in the case where the installation is for a single dock and single boat. This version would simply mount the docking car and bumpers to the dock or to pilings, and would dispense with the in-dock tracks. This version will be available with or without horizontal tracks for side-to-side adjustment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Docking system, comprising:

a mounting system;

a docking car assembly slideably mounted on said mounting system, said docking car comprising a support member;

at least one bumper mounted on said support member;

a biasing system for urging said docking car assembly in a first direction on said mounting system; and a docking line connected to said docking car assembly, wherein when a force is placed on said docking line, said docking car is urged in a direction opposite to said first direction;

wherein said support member has a front face and a rear face, and mounting rings are provided on said rear face; and wherein the front face of a mounting plate is provided with longitudinally extending rod members which are spaced apart from each other by the same distance as the mounting rings so as to permit the mounting rings to be slideably mounted on the rod members.

2. Docking system according to claim 1, wherein said mounting system comprises a mounting plate having a front face and a rear face, said rear face being provided with an attachment bracket for mounting the mounting plate to a support.

3. Docking system according to claim 2, wherein said support is a pylon.

4. Docking system according to claim 1, wherein said support member carries at least two bumpers.

5. Docking system according to claim 4, wherein the support member is provided with two apertures through which said docking line extends.

6. Docking system according to claim 5, wherein at least one guide member is provided on a rear face of the support member over which the docking line passes.

7. Docking system according to claim 1, wherein each rod member is provided with a biasing system to urge the mounting rings upwardly on the rod members.

8. Docking system according to claim 1, wherein the biasing system comprises springs retained on the respective rod member by stop members.

9. Docking system according to claim 8, wherein the mounting rings have an internal diameter and said rod members have an external diameter, the internal and external diameters being such that the rod members and the rings are slideably engageable.

10. Docking system according to claim 1, wherein a jam cleat is provided on the front face of the support member to secure said docking line.

11. A docking assembly suitable for mounting on a dock or quay, comprising:

a docking system as claimed in claim 1;

first and second bumper carrying devices positionable on a dock or quay on either side of said docking system, and spaced from said docking system by a distance such that when a craft is secured to said docking system, and bumpers on said bumper carrying devices are in contact with the craft, rotation of the craft about said docking system is prevented.

12. Docking assembly according to claim 11, wherein each of said bumper carrying devices is mountable on an in-dock track recessed into a dock.

13. Docking assembly according to claim 11, wherein the docking system is mounted on a bumper carrying device disposed in an in-dock track, and is moveable towards and away from the craft.

14. Docking assembly according to claim 11, wherein said bumper carrying device includes a tripod frame including outrigger members wherein a lower end of each outrigger member is connected to a wheel and wherein an upper end of each outrigger member is connected to a sloping central member.

15. Docking assembly according to claim 14, wherein a lower end of the sloping member is connected to a foot which is configured to slideably engage with an in-dock track.

16. Docking assembly according to claim 15, wherein the frame is provided with a carrying unit at an opposite end to the foot, said carrying unit including upper and lower tracks on which bumpers or a docking car may be mounted.

17. Docking assembly according to claim 15, wherein the in-dock track includes keeper members positioned longitudinally along the length of the track and defining spaces which extend a distance longitudinally which is slightly longer than the length of the foot.

18. Docking assembly according to claim 17, wherein said track has a base in which a hole is located between each of the keeper members, said hole receiving a fastening pin mounted to the foot by passing the pin through a hole in the foot into said hole in the base of the track, to thereby fasten the foot in a desired position in the track.

19. Method for docking a craft at a dock or quay, comprising:

bringing a craft alongside a docking assembly comprising a docking system as claimed in claim 1, and first and second bumper carrying devices positioned on the dock or quay on either side of the docking system, said first and second bumper carrying devices being spaced from said docking system by a distance such that when the craft is secured to said docking system, and bumpers on said bumper carrying devices are in contact with the craft, rotation of the craft about said docking system is prevented;

hitching the docking line to a center cleat of the craft;

pulling on the docking line to draw the craft into contact with bumpers on said docking system and cleating said docking line;

moving said bumper carrying devices to bring the bumpers carried by said bumper carrying devices into contact with the craft on either side of the docking system.

20. Method according to claim 19, wherein said bumper carrying device includes a tripod frame including outrigger members provided with a wheel connected to a lower end of each outrigger member, and the upper end of each outrigger member being connected to a sloping central member.

21. Method according to claim 20, wherein a lower end of the sloping member is connected to a foot which is configured to slideably engage with an in-dock track.

22. Method according to claim 21, wherein the foot is provided with a pin, and the foot is located in the track and moved to a position where the pin is inserted though a hole in the foot into a respective hole in the base of the track to fix the position of the foot.

* * * * *